United States Patent [19]

Wilson

[11] Patent Number: 4,706,918

[45] Date of Patent: Nov. 17, 1987

[54] LADDER ACCESSORY

[75] Inventor: Randall J. Wilson, Don Mills, Canada

[73] Assignee: Wilson Reil Associates Limited, Ontario, Canada

[21] Appl. No.: 44,654

[22] Filed: May 1, 1987

[51] Int. Cl.[4] ..... E06C 7/14; E06C 5/32

[52] U.S. Cl. ..... 248/210; 182/129; 182/120; 15/257.06

[58] Field of Search ..... 182/129, 120, 121; 248/210, 211; 15/257.06

[56] References Cited

U.S. PATENT DOCUMENTS

| | | | |
|---|---|---|---|
| 2,597,756 | 5/1952 | Sitex | 248/210 |
| 3,252,613 | 5/1966 | McGrath | 248/210 |
| 3,553,762 | 1/1971 | Padgett | 15/257.06 |
| 3,568,801 | 3/1971 | Werner | 182/214 |
| 3,642,240 | 2/1972 | Hershey | 248/210 |
| 4,164,299 | 8/1979 | Fuhr | 15/257.06 |
| 4,205,411 | 6/1980 | Cupp | 248/210 |

FOREIGN PATENT DOCUMENTS

| | | | |
|---|---|---|---|
| 2536329 | 2/1977 | Fed. Rep. of Germany | 248/210 |
| 779845 | 1/1935 | France | 248/210 |
| 1029741 | 3/1953 | France | 248/210 |

*Primary Examiner*—Reinaldo P. Machado

[57] ABSTRACT

A ladder accessory with an upwardly open receptacle is designed to rest on a rung of a ladder or step-ladder and its shape cooperates with one upright of the ladder prevent transverse movement of the accessory or rotation in either direction relative to the ladder.

6 Claims, 4 Drawing Figures

LADDER ACCESSORY

This invention relates to a ladder accessory designed to detachably rest on the rung of a ladder and to stably support such things as a paint roller or to stably provide a receptacle for paint, for tools or the like.

By 'outward' and 'inward' herein, I means the sides of a ladder sloping upwardly toward a structure which are farther and nearer respectively to the structure.

It is an object of the invention to provide a ladder accessory having an upwardly open receptacle designed to be located outside the ladder, an upwardly open receptacle designed to be located inside the ladder and to be inserted between the ladder uprights. (By receptacle I include multiple receptacles such as a basin for paint or to hold a paint roller tray, or to hold tools or other articles). The outer receptacle and inner receptacle and connecting means between them are designed to define a downwardly opening groove which will receive a ladder rung and the connecting means. Means bordering the groove are designed to support the inner and outer receptacle in approximately level attitude while other means cooperate with a ladder upright to limit movement of the accessory transversely relative to the ladder.

The invention includes a ladder accessory for use with plain or extension ladders, on the one hand, and a step-ladder, on the other hand. A preferred embodiment to be described hereafter is adaptable for either.

It is an object of a preferred aspect of the invention to provide a ladder accessory as described in the second previous paragraph having transverse movement locating means associated with one upright of the ladder, where the outer receptacle is combined with means cooperating with an upright of the ladder for preventing rotation of the accessory on the rung in a direction which is downward for the outer member, and other means, cooperating with an upright of the ladder for preventing rotation of the rung beyond a very small angle in a direction which is upward for the outer member Thus the accessory is fixed on the ladder against transverse movement or rotation in either direction.

Other objects and advantages of the invention will become apparent from the description of the preferred embodiment, to follow.

In drawings which illustrate a preferred embodiment of the invention:

The accessory to be described is preferably a single piece of molded plastic shaped as described.

Figure 1:
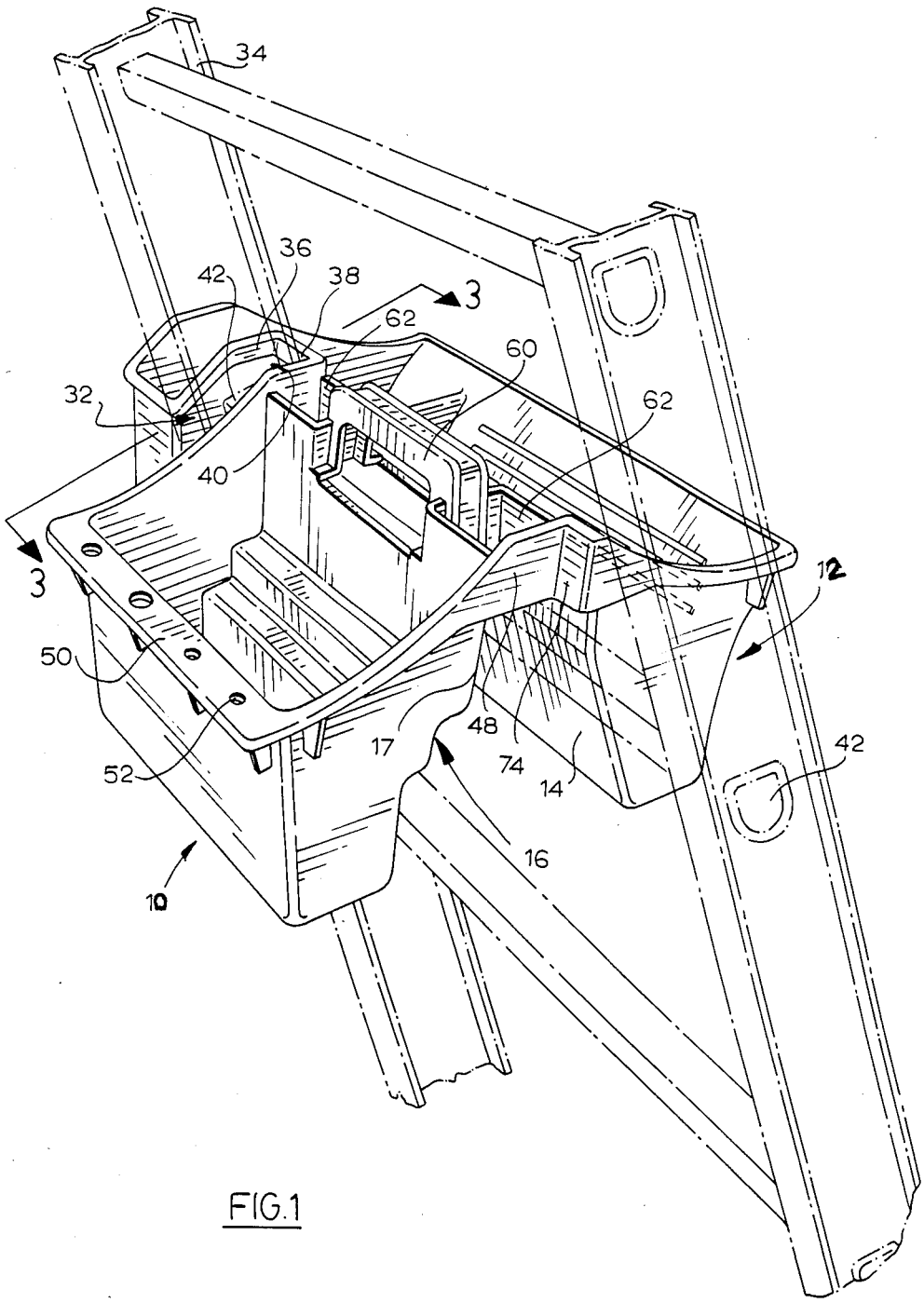
FIG. 1 shows a perspective of a preferred embodiment of the invention located on an ordinary ladder.

In the drawings, an inner upwardly open receptacle 10 is connected, by connecting means to be described to an outer, upwardly open receptacle 12. The inner receptacle 10 is dimensioned to go between the uprights, and the adjacent rungs of a ladder. (Unless qualified 'ladder' herein refers either to ordinary or extension ladders, on the one hand, or to step-ladders on the other). The inner and outer receptacles and the connecting means define between them a downwardly opening groove. Such groove is defined by inner wall 14 of the outer member which is designed in the preferred attitude of the accessory, to slope at the angle of the latter rungs. The groove is defined by the outer wall of the inner member having from the top, downwardly extending outwardly facing wall 16. Wall 16 includes an upper first step formed by downwardly facing wall 18 and outwardly facing wall 20, extending vertically from the inner end of wall 18, and a lower second step formed by horizontal wall 22 extending inwardly from the lower end of wall 20 and a nearly vertical wall 24 extending down from the inner end of wall 22 to the bottom of the inner receptacle. The inner and outer receptacles are joined by connecting means comprising downwardly facing concave ridges 26 and 28. The outer receptacle is extended transversely beyond the inner to a side receptacle 30. As shown best in FIGS. 1 and 2 the side receptacle 30, outer receptacle 12 and inner receptacle 10 are shaped to define inwardly facing groove 32 dimensioned to receive the right hand upright 34 of a ladder. (The device may, of course, be designed to be 'left handed' if desired). So far as registration with the ladder rung is concerned, flanges 36, 38 and 40 of the members 30, 12 and 10 respectively are at upper edges of walls of the respective members which are curved from the respective wall upward toward the groove and a short distance downward to form the flanges. Flanges 36 and 40 must be spaced widely enough to receive all of the ladder uprights normally encountered and this will allow some transverse play when the upright is narrower. However, this small transverse play does not matter and the groove 32 thus defined still acts to position the accessory against transverse movement on the ladder, which exceeds the allowed play.

Figure 2:
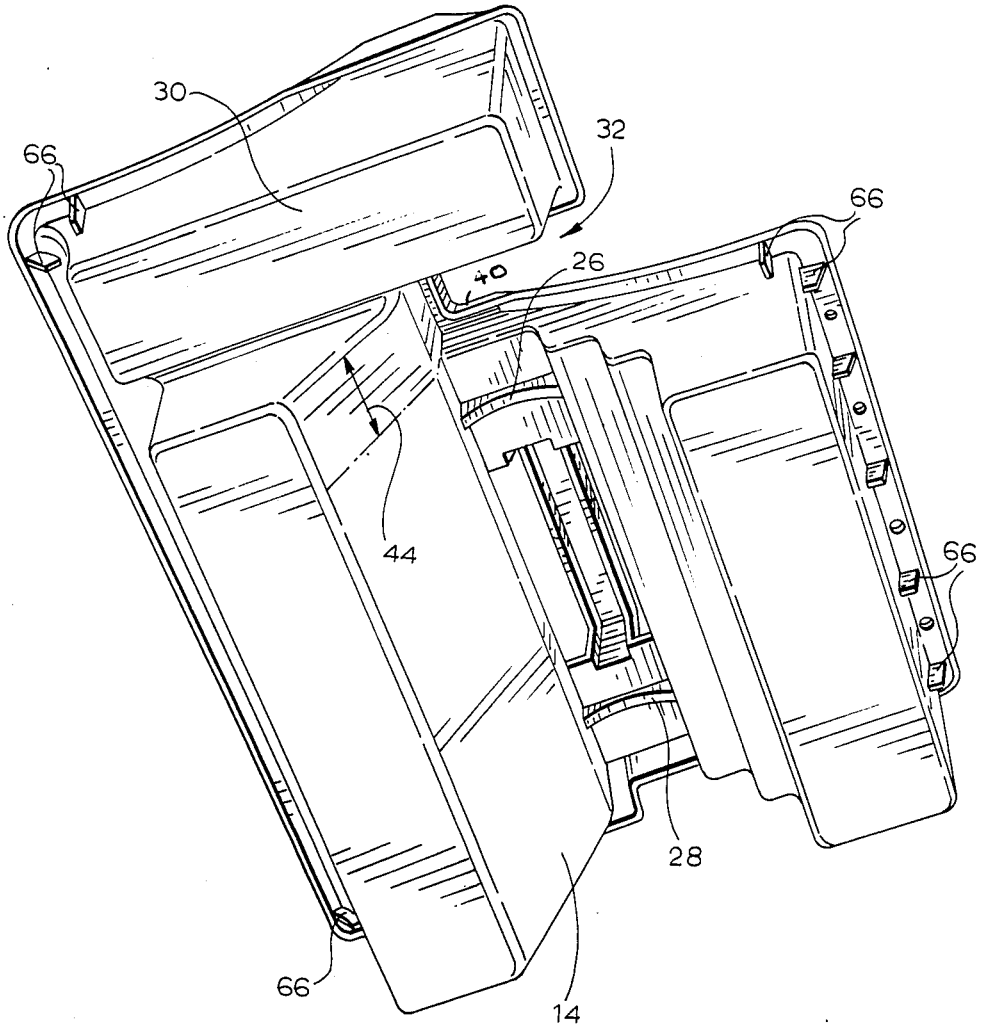
FIG. 2 shows the lower side of the device of FIG. 1.
Figure 3:
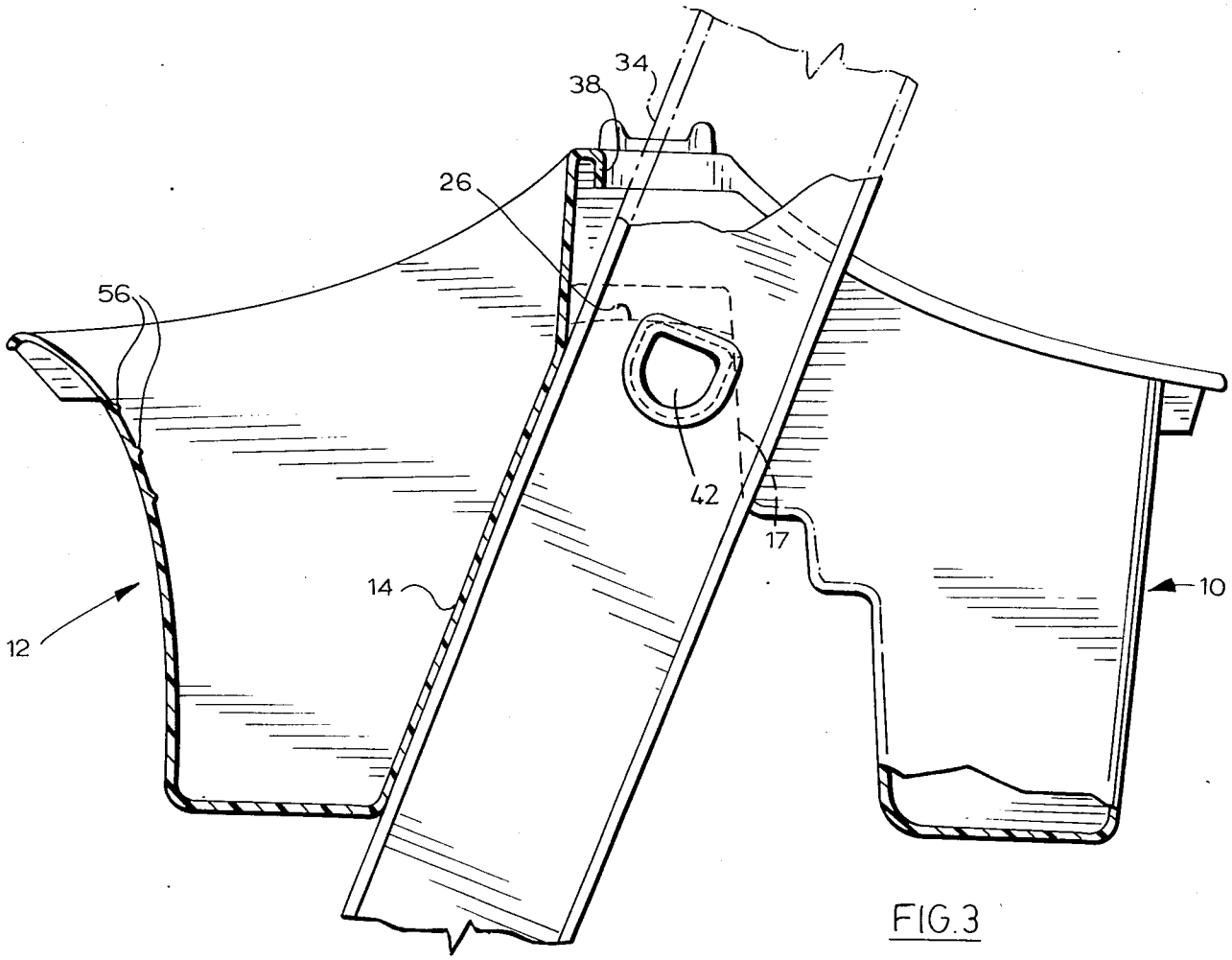
FIG. 3 shows a vertical section, transverse to the ordinary ladder rung to show the cooperation between the accessory and the ladder.

As best shown in FIG. 3 the transverse groove defined by upper extent 17 of wall 16 and by the opposed face of wall 14 receives the ordinary ladder rung 42 and the accessory is then supported by ridges 26 and 28 seated on rung 42 as best shown in FIG. 3. As previously stated, transverse movement of the accessory on the ladder is prevented by edges 36 and 40. Any tendency, due to loading or chance impact of the accessory to rotate on the rung in a direction which brings the outer receptacle upwardly is prevented by contact of edge 38 with the outer surface of the ladder upright 34. (It is easier to mold the accessory with a small clearance, best shown in FIG. 3, between edge 38 and the upright 34). Thus, if upward pressure is exerted on the outer receptacle in its attitude of FIG. 3, it will rotate the short distance for flange 38 to contact rung 34, but no further, and such small rotation is unlikely to cause spillage or the dropping of implements. Rotation of the accessory on the rung 42 in a direction to lower the outer receptacle is prevented by an extent of wall 14 which extends transversely over a transverse extent 44 which is opposite groove 32 (FIG. 2). The extent 44, in the intended attitude of the device thus rests on upright 34 preventing rotation of the accessory about the rung in a direction to carry the outer receptacle downward.

Figure 4:
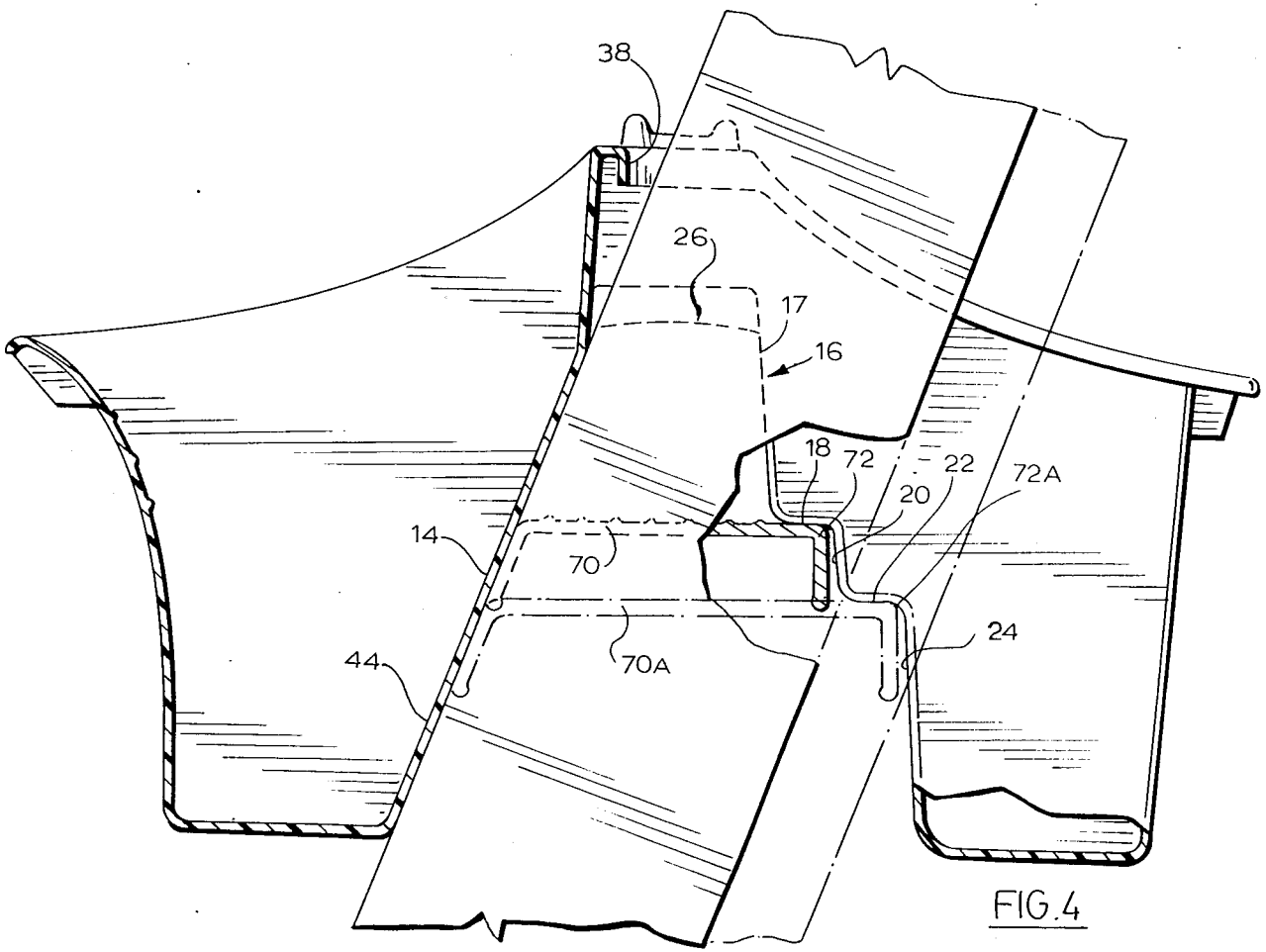
FIG. 4 shows a vertical section similar to that of FIG. 3, but showing a step ladder instead of an ordinary ladder.

FIG. 4 illustrates the criteria for support of the accessory on a step-ladder. The flat steps 70 or 70A of the step-ladder support the accessory with the outer edge of the step contacting wall 14. Notches are provided in wall 16 to receive the inner top corner 72 or 72A of the step 70 or 70A. Preferably, the notch for a narrower step 70 is provided by walls 18 and 20 and the notch for a wider step 70A is provided by walls 22 and 24. Edges 36, 40 cooperate with the ladder upright to prevent transverse movement and edge 38 and wall 14 prevent rotation of the accessory about the ladder step, all as described in relation to the ordinary ladder.

Thus, in the manners above described, the accessory, supported on the rung of an ordinary or extension ladder is limited against lateral movement or rotation in either direction about the rung.

As indicated in the drawings a strengthening flange extends about the upper periphery of the inner and outer receptacles, their connecting member and the side receptacle. Such flange includes extents 36,38 and 40 previously referred to. On the transverse sides the depth of the outer portion may be increased as best shown at 48 of FIG. 1. The innermost extent of the flange is preferably widened as indicated at 50 any may be provided with variously shaped apertures 52 for holding screwdrivers or other tools. The outer receptacle is preferably shaped to receive a paint roller and so that it may be filled with paint and used with the roller. For this reason the inner surface of the outer wall of receptacle 12 is preferably curved outwardly in an upward direction as shown and provided with ribs 56 to assist in rotation of the roller. The inner and side receptacles may be shaped, subject to the constraints for ladder positioning and stabilization previously described, as desired to perform chosen 'receptacle' functions, and each receptacle may be subdivided into smaller receptacles. The connecting means, in addition to ribs 26 preferably includes a handle 60 and small receptacle areas 62 at each end thereof.

The accessory is preferably designed and tapered for stacking in a nested arrangement with similar accessories. An upwardly narrowing, downwardly facing groove is provided between the outer portions of side member 30 and outer member 12 to assist in such stacking. As best shown in FIG. 2 spacers 66 perpendiclar to the adjacent peripheral flange and wall extents are provided beneath the peripheral flange at spaced intervals. Such spacers 66 strengthen the adjacent flange and wall, particularly at the corners and also act to set a predetermined spacing between adjacent rested accessories.

It will be noted (FIG. 1) that the accessory is stepped inward at 74 passing from the outer receptacle to the connecting means. The resulting narrower transverse profile for the connecting means and inner receptacle is preferred to allow use of the accessory between the relatively narrowly spaced ladder uprights near their upper extremity.

It will be noted that the accessory bottom, in its preferred form is flat so that when not in use it may be rested stably on a flat surface.

I claim:

1. Ladder accessory comprising:

for use on a sloping ladder, comprising:

outer means defining an outer upwardly open receptacle for location on the outside of said ladder, inner means defining an upwardly opening receptacle for location on the inside of said ladder, said inner means being dimensioned to extend between the uprights of said ladder, connecting means connecting said outer and inner means, said outer, inner and connecting means being shaped to define a transverse downwardly open groove wide enough to receive a rung of said ladder, support members on said connecting means for resting on a rung of said ladder when said rung is in said groove, means for cooperation with an upright of said ladder for defining the transverse location of said inner and outer means relative to said ladder with said connecting means extending between said uprights, means for maintaining said inner and outer means in an attitude where they are at approximately the same height when said connection means is located upon said rung.

2. Ladder accessory as claimed in claim 1 wherein a first stop surface on said outer member is designed, when said support member is resting on said rung to contact said ladder upright, below such rung and to limit rotation of said outer member in a direction which is downward relative to said inner member, said maintaining means including said first stop surface.

3. Ladder accessory as claimed in claim 1 wherein a surface or said outer member is designed, when said support member is resting on said rung, to contact said ladder upright, above said rung, after on a short rotation of said accessory to lower said inner means from a position where said inner and outer means are at equal height, said maintaining means including said first stop surface.

4. Ladder accessory as claimed in claim 2 wherein a surface or said outer member is designed, when said support member is resting on said rung, to contact said ladder upright, above said rung, after on a short rotation of said accessory to lower said inne means from a position where said inner and outer means are at equal height, said maintaining means including said first stop surface.

5. Ladder accessory as claimed in claim 1 wherein said support member includes a sloping inwardly facing surface on said outer member, said sloping surface partially defining said downwardly facing groove, and being designed to rest against said ladder upright and to prevent rotation of said accessory in a direction which is downwardly for said outer member, relative to said rung; and a wall on said inner member, partially defining said downwardly facing groove, said wall including at least one notch designed to contact the inner top edge of a step-ladder step when the sloping surface is resting against said ladder upright, to provide a stop against rotation of said accessory in a direction which is downward for said inner means.

6. Ladder accessory as claimed in claim 5 wherein said notch comprises a downwardly facing surface extending inwardly from the outwardly facing contour of said inner member and an outwardly facing surface extending downward from the inward end of said downwardly facing surface.

* * * * *